United States Patent [19]

Tucker et al.

[11] 4,107,872

[45] Aug. 22, 1978

[54] ACTION TOY FOR LAND AND WATER

[75] Inventors: James E. Tucker, Oak Park; Joseph M. Burck, Chicago; Howard J. Morrison, Deerfield, all of Ill.

[73] Assignee: Marvin Glass & Associates, Chicago, Ill.

[21] Appl. No.: 821,702

[22] Filed: Aug. 4, 1977

[51] Int. Cl.[2] ..... A63H 11/10

[52] U.S. Cl. ..... 46/103; 46/92

[58] Field of Search ..... 46/91, 92, 96, 99, 202, 46/222, 97, 103, 106, 116, 119, 120

[56] References Cited

U.S. PATENT DOCUMENTS

| | | | |
|---|---|---|---|
| 1,461,932 | 7/1923 | Penksa | 46/106 |
| 2,997,299 | 8/1961 | Wilkins, Jr. | 46/92 |
| 3,638,353 | 2/1972 | Fryc et al. | 46/92 |
| 3,733,739 | 5/1973 | Terzian | 46/206 |
| 3,835,583 | 9/1974 | Manning | 46/201 |

FOREIGN PATENT DOCUMENTS

| | | | |
|---|---|---|---|
| 480,564 | 2/1938 | United Kingdom | 46/103 |

*Primary Examiner*—Louis G. Mancene
*Assistant Examiner*—Mickey Yu
*Attorney, Agent, or Firm*—Mason, Kolehmainen, Rathburn & Wyss

[57] ABSTRACT

An action toy for children of tender years useful on land and water comprises a body having an outer surface shaped to resemble a human form in a generally horizontal position as in riding the surf. The body includes a pair of forwardly extending spaced apart arms and a pair of rearwardly extending spaced apart legs. A pair of relatively large wheels formed of flotation material such as resilient foam are mounted for rotation on a pair of spaced apart transverse axes extending between opposite outer end portions of the arms and legs respectively, and a power source such as a rubber band is provided for rotatively driving at least one of the wheels to propel the toy across a supporting surface or across the water.

10 Claims, 3 Drawing Figures

10
12
14
16
18
20
20a
22
24
26
26a
28
30
32
34
36
3
3

ACTION TOY FOR LAND AND WATER

BACKGROUND OF THE INVENTION

1. Field of the Invention

The present invention relates to a new and improved action toy for children of tender years. More particularly, the action toy is especially adapted for play and movement along a solid supporting surface but is additionally capable of floating on and moving across the surface of the water.

2. Description of the Prior Art

Many types of toys have been made resembling the human form and many types of toys have been developed which are suitable for use both in the water and on a solid surface. The present invention relates to an action type toy which is self-propelled for movement along a solid surface and which will float and is movable along the surface of the water. The toy is made to resemble human form in a general horizontal position as in riding the waves or surf.

SUMMARY OF THE INVENTION

It is an object of the invention to provide a new and improved action toy for children, which toy resembles the human form in a generally horizontal position as in riding the surf.

Another object of the invention is to provide a toy of the type described which is self-propelled for movement along a solid surface and which is also floatable of the water and self-propelled for movement across the water in similar fashion so as to resemble a surfer.

The foregoing and other objects and advantages of the present invention are accomplished in a new and improved action toy for children comprising a body having an outer surface shaped to resemble the human form in a generally horizontal position as in riding the surf or waves. The body includes a pair of forwardly extending spaced apart arms and a pair of rearwardly extending spaced apart legs. The body includes a head with a helmet having an eye piece directed forwardly toward the outer end portions or hands on the spaced apart arms. A pair of relatively large cylindrical wheels which are formed of low density floating material such as resilient foam are mounted for rotation on a pair of spaced apart front and rear transverse axes which extend between opposite outer end portions of the arms and legs of the body, respectively. Drive means is provided for rotating at least one of the wheels to propel the toy across a solid supporting surface. The lightweight wheels also provide sufficient buoyancy for supporting the toy in water and when the wheels are rotatively driven the toy is propelled across the surface of the water and resembles a human being riding the surf.

BRIEF DESCRIPTION OF THE DRAWINGS

For a better understanding of the present invention, reference should be had to the following detailed description taken in conjunction with the drawings in which.

DESCRIPTION OF THE PREFERRED EMBODIMENT

Figures 1, 2, 3:
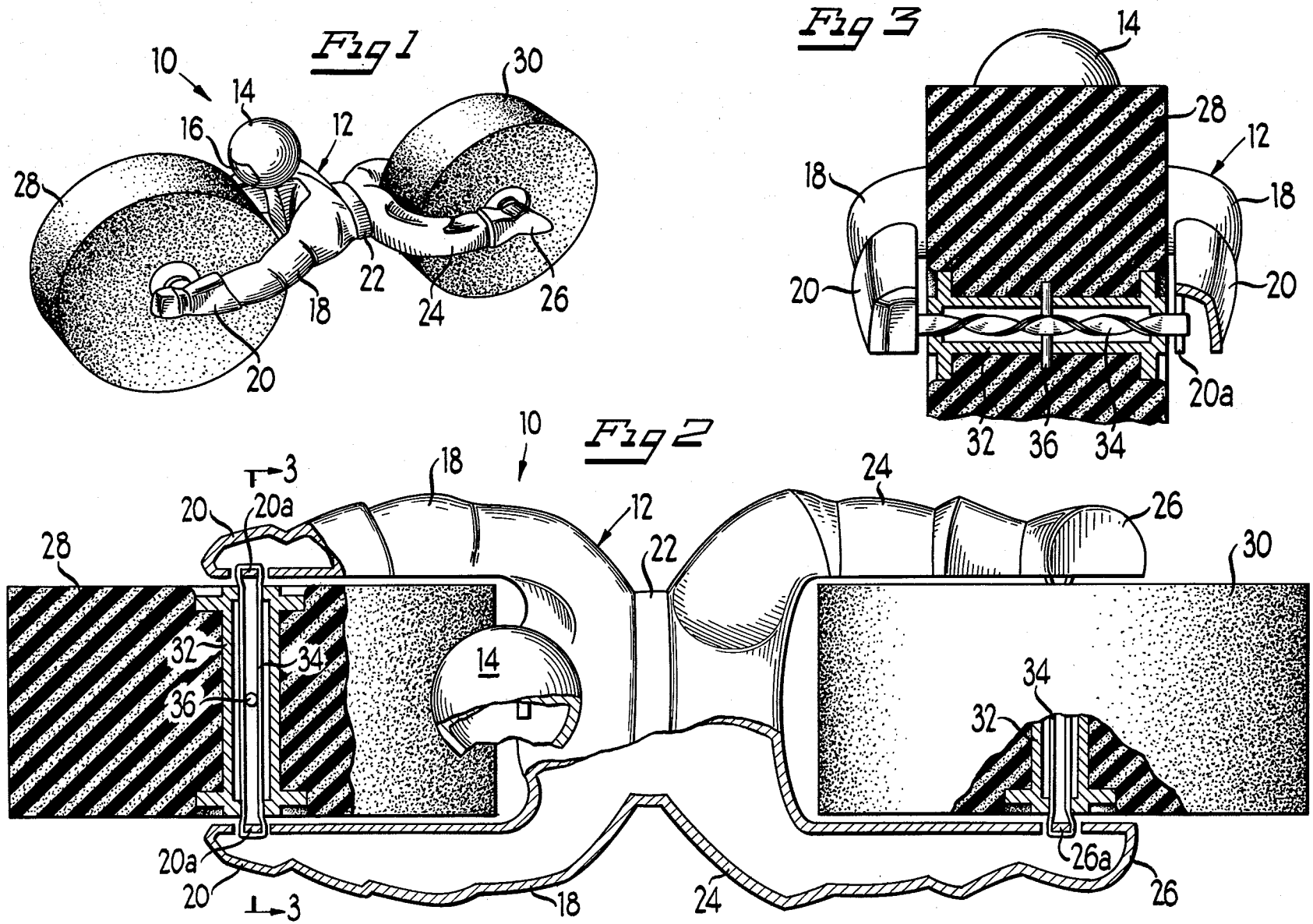
FIG. 1 is a perspective view of an action toy in accordance with the principles of the present invention.
FIG. 2 is a top plan view of the toy with portions thereof shown in section and broken away for a better understanding of the construction.
FIG. 3 is a transverse cross-sectional view taken substantially along lines 3—3 of FIG. 2.

Referring now more particularly to the drawings, therein is illustrated a new and improved action toy for children and the like referred to generally by the reference numeral 10. The toy is shaped to resemble a human form in a generally horizontal position as in riding the waves or surf and includes a body 12 of hollow, lightweight, molded plastic material including a generally spherical head 14 having an eye piece portion 16 facing forwardly in the same direction as a pair of forwardly extending, spaced apart arm members 18 having gloved hand portions 20 at the outer extremities. The body 12 also includes a belted middle portion or waist 22 and a pair of hollow, spaced apart, legs extending rearwardly thereof referred to by the reference numeral 24. At the outer end portions of the legs, boots or other elements of foot wear 26 are provided.

In accordance with the present invention, the body 12 supports a pair of relatively large, generally cylindrical, front and rear flotation wheels referred to by the numerals 28 and 30, respectively. The wheels are identical and are formed to lightweight, resilient, foam material to provide sufficient flotation buoyancy when the toy is used in the water. The relatively large size of the wheels also provide ample support for the toy when used on a solid surface or land.

At the center of each wheel is provided a hollow, tubular, central hub section 32 preferably formed of relatively stiff, molded plastic material for supporting the resilient foam of the outer portion of the wheels. The hollow hub of each wheel is carried on a looped rubber band 34 which forms an axle and the rubber band has opposite ends looped around a pair of dependent tabs **20*a* and 26*a*, respectively, formed on the lower edges of the gloves and boots at the outer ends of the arms and legs, respectively, as best shown in FIGS. 2 and 3. At the center portion of the hubs 32, there is provided a key pin 36 which extends between opposite runs of the looped rubber band and into the hub so that when the wheels are rotated, the rubber bands 34 are wound up or twisted as shown in FIG. 3**. After one or more of the rubber bands are twisted and wound up by rotation of the wheels the surf man toy is then released in the water or on solid supporting surface and the wheels are driven to rotate by the unwinding rubber band axles to propel the toy along. The rubber bands on the front and rear wheels may be wound up in opposite directions if desired to provide skidding, skipping and slippage in the water or on a solid surface and after release, the toy will run a distance in response to stronger rubber bands until the rubber bands wind down. The toy may also be propelled along a surface to rewind the bands in the same direction.

The large resilient wheels provide flotation support for the toy which is adapted to be self-propelled either in the water or on a solid surface. The resilient wheels also provide a soft medium so that the toy does not damage furniture or other objects that it comes into contact with during play.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An action toy for children comprising:

a body having an outer surface shaped to resemble the human form in a generally horizontal position as in riding the surf;

said body including a pair of forwardly extending spaced apart arms and a pair of rearwardly extending spaced apart legs forming spaced apart recesses at opposite ends of said body;

a pair of relatively large cylindrical wheels mounted in said recesses formed of deformable, lightweight flotation material and mounted for rotation on a pair of spaced apart axes extending transversely between opposite outer end portions of said arms and legs, respectively; and means for rotatively driving at least one of said wheels to propel said toy across a supporting surface.

2. The action toy of claim 1 wherein said means for rotatively driving said wheels comprises at least one rubber band non-rotatively secured at opposite ends to said body and extending through a central axis of said wheel for supporting the same.

3. The action toy of claim 2 wherein said wheel includes a hub portion around said rubber band and keyed to wind up said rubber band upon manual rotation of said wheel and operable to rotate said wheel upon release as said rubber band unwinds.

4. The action toy of claim 2 wherein said rubber band is secured between said arms of said body.

5. The action toy of claim 2 wherein said rubber band is secured between said legs of said body.

6. The action toy of claim 4 including a pair of rubber bands supporting said wheels and secured between said arms and said legs respectively of said body.

7. The action toy of claim 1 wherein said body includes a head portion between said arms positioned to look forwardly over said wheel supported between said arms.

8. The action toy of claim 2 wherein said body includes a pair of depending fingers on opposite sides for engaging opposite ends of said rubber band.

9. The action toy of claim 1 wherein said wheels are formed of light weight cellular foam material.

10. The action toy of claim 9 wherein said body is hollow and formed of molded plastic material whereby said toy will float in water.

* * * * *